US008056149B2

(12) United States Patent
Duclos

(10) Patent No.: US 8,056,149 B2
(45) Date of Patent: Nov. 15, 2011

(54) COMBINATION SOCK AND SHOE

(75) Inventor: Gary Paul Duclos, Newburyport, MA (US)

(73) Assignee: Converse Inc., North Andover, MA (US)

( * ) Notice: Subject to any disclaimer, the term of this patent is extended or adjusted under 35 U.S.C. 154(b) by 860 days.

(21) Appl. No.: 11/961,245

(22) Filed: Dec. 20, 2007

(65) Prior Publication Data

US 2009/0158503 A1 Jun. 25, 2009

(51) Int. Cl.
*A43B 17/18* (2006.01)
*A43B 23/02* (2006.01)

(52) U.S. Cl. ..... 2/239; 36/109

(58) Field of Classification Search ..... 2/239, 240, 2/241; 36/1.5, 2 R, 83, 99, 102, 109, 113, 36/114, 112, 10, 12, 55, 15, 9 R
See application file for complete search history.

(56) References Cited

U.S. PATENT DOCUMENTS 1,418,188 A * 5/1922 Jacobs ..... 36/85
1,472,415 A * 10/1923 Haggerty ..... 36/89
2,415,004 A * 1/1947 Feldhake ..... 36/102
2,538,673 A * 1/1951 Donahue ..... 36/9 R
2,586,045 A * 2/1952 Hoza ..... 36/9 R
2,659,911 A * 11/1953 Spack ..... 12/142 R
2,679,117 A * 5/1954 Reed ..... 36/9 R
3,035,291 A * 5/1962 Bingham, Jr. ..... 12/142 RS
3,475,835 A * 11/1969 Kovar ..... 36/1.5
3,744,163 A * 7/1973 Simister ..... 36/97
3,863,272 A * 2/1975 Guille ..... 2/239
4,169,324 A * 10/1979 Gibbs ..... 36/83
4,276,671 A * 7/1981 Melton ..... 12/142 T
4,317,292 A * 3/1982 Melton ..... 36/9 R
4,538,368 A * 9/1985 Mugford ..... 36/112
4,599,810 A * 7/1986 Sacre ..... 36/55
4,713,895 A * 12/1987 Vallieres ..... 36/1.5
4,809,447 A * 3/1989 Pacanowsky et al. ..... 36/9 R
4,845,862 A * 7/1989 Phillips et al. ..... 36/83
4,852,272 A * 8/1989 Chilewich et al. ..... 36/12
4,907,350 A * 3/1990 Chilewich et al. ..... 36/19 R
4,926,568 A * 5/1990 Coffman ..... 36/15
4,967,494 A * 11/1990 Johnson ..... 36/9 R
5,067,260 A * 11/1991 Jenkins, Jr. ..... 36/7.1 R
5,157,791 A * 10/1992 Woodson et al. ..... 2/239
5,165,182 A * 11/1992 Michael ..... 36/1.5
5,325,541 A * 7/1994 Willard ..... 2/239
5,353,524 A * 10/1994 Brier ..... 36/55
5,381,610 A * 1/1995 Hanson ..... 36/100
5,553,399 A * 9/1996 Strong ..... 36/9 R
5,617,585 A * 4/1997 Fons et al. ..... 2/239
5,774,898 A * 7/1998 Malpee ..... 2/239
5,937,543 A * 8/1999 Hall et al. ..... 36/10
6,047,434 A * 4/2000 Falwell ..... 15/227

(Continued)

*Primary Examiner* — Alissa L Hoey
(74) *Attorney, Agent, or Firm* — Shook, Hardy & Bacon L.L.P.

(57) ABSTRACT

A combination sock and shoe includes a shoe sole, an exterior sock that is secured to the shoe sole, an intermediate sock positioned inside the exterior sock, and an interior sock positioned inside the exterior sock and inside the intermediate sock. The intermediate sock is constructed as an anklet having an elastic ankle opening. The exterior and interior socks conceal the intermediate sock from view by sandwiching the intermediate sock between them. When a wearer's foot is inserted into the combination sock and shoe, the elastic ankle opening of the intermediate sock securely engages around the ankle of the wearer's foot and holds the wearer's foot to the shoe sole, thereby preventing the shoe sole from separating away from the heel of the wearer's foot during walking.

5 Claims, 4 Drawing Sheets

U.S. PATENT DOCUMENTS

| | | | | |
|---|---|---|---|---|
| 6,148,544 | A * | 11/2000 | Keen et al. | 36/1.5 |
| 6,308,438 | B1 * | 10/2001 | Throneburg et al. | 36/9 R |
| 6,662,377 | B2 * | 12/2003 | Williams | 2/239 |
| 6,665,883 | B2 * | 12/2003 | Sloan | 2/239 |
| 6,807,683 | B2 * | 10/2004 | Williams | 2/239 |
| 6,836,916 | B2 * | 1/2005 | Chen et al. | 12/142 A |
| 6,851,205 | B2 * | 2/2005 | Chen et al. | 36/55 |
| 6,880,268 | B2 * | 4/2005 | Chen | 36/43 |
| 7,159,335 | B2 * | 1/2007 | Chen | 36/4 |
| 7,370,438 | B2 * | 5/2008 | Vattes et al. | 36/10 |
| 7,434,336 | B2 * | 10/2008 | Kosted | 36/10 |
| 2001/0037587 | A1 * | 11/2001 | Lu | 36/14 |
| 2001/0049886 | A1 * | 12/2001 | Chen | 36/12 |
| 2001/0049889 | A1 * | 12/2001 | Chen | 36/55 |
| 2002/0120977 | A1 * | 9/2002 | Smith | 2/242 |
| 2003/0093919 | A1 * | 5/2003 | Wang | 36/10 |
| 2004/0010938 | A1 * | 1/2004 | Li-Wang et al. | 36/9 R |
| 2004/0098880 | A1 * | 5/2004 | Chen et al. | 36/14 |
| 2004/0143996 | A1 * | 7/2004 | Chen et al. | 36/55 |
| 2004/0187352 | A1 * | 9/2004 | Chen et al. | 36/55 |
| 2004/0226076 | A1 * | 11/2004 | Chen | 2/239 |
| 2005/0066544 | A1 * | 3/2005 | Beak | 36/43 |
| 2005/0076541 | A1 * | 4/2005 | von Blucher | 36/113 |
| 2005/0102862 | A1 * | 5/2005 | Baychar | 36/55 |
| 2006/0026740 | A1 * | 2/2006 | Vargas et al. | 2/239 |
| 2006/0112591 | A1 * | 6/2006 | Lombardo | 36/7.5 |
| 2006/0117598 | A1 * | 6/2006 | Czaplewski et al. | 36/2 R |
| 2006/0137223 | A1 * | 6/2006 | Ziccarelli | 36/55 |
| 2006/0225186 | A1 * | 10/2006 | Davenport | 2/239 |
| 2007/0062067 | A1 * | 3/2007 | Covatch | 36/55 |
| 2007/0118974 | A1 * | 5/2007 | Hexels | 2/239 |
| 2007/0271819 | A1 * | 11/2007 | Chen | 36/43 |
| 2008/0005927 | A1 * | 1/2008 | Hung | 36/15 |
| 2008/0066347 | A1 * | 3/2008 | Suzuki | 36/83 |
| 2008/0282578 | A1 * | 11/2008 | von Blucher | 36/98 |
| 2009/0000012 | A1 * | 1/2009 | Hsieh | 2/240 |
| 2009/0019731 | A1 * | 1/2009 | Braynock et al. | 36/100 |

* cited by examiner

COMBINATION SOCK AND SHOE

BACKGROUND OF THE INVENTION

1. Field of the Invention

The present invention pertains to a novel construction of a combination sock and shoe that is securely held to the foot of a wearer. In particular, the present invention pertains to a combination sock and shoe that includes a conventionally constructed athletic shoe sole, an exterior sock that is secured to the shoe sole, intermediate sock that is positioned inside the exterior sock, and an interior sock that is positioned inside the intermediate sock. The interior sock is constructed of substantially the same material as the exterior sock. The intermediate sock is constructed as an anklet having an elastic ankle opening. The exterior and interior socks conceal the intermediate sock from view by sandwiching the intermediate sock between them. When a wearer's foot is inserted into the combination sock and shoe, the elastic ankle opening of the intermediate sock securely engages around the ankle of the wearer's foot and holds the wearer's foot to the shoe sole, thereby preventing the shoe sole from separating away from the heel of the wearer's foot during walking.

2. Description of the Related Art

Casual shoes and slippers have been constructed that are combinations of a shoe sole and a sock. The prior art combination shoe and sock is basically constructed by securing the bottom surface of a sock to a top surface of a shoe sole. However, in the prior art combination shoe and sock construction, because the shoe sole is typically more rigid and less flexible than the material of the sock, when the wearer of the combined shoe and sock walks, the heel of the wearer's foot will often lift up from the shoe sole, causing the heel to move up into the portion of the sock that typically surrounds the wearer's ankle. This can result in the portion of the sock that now surrounds the wearer's heel to move between the wearer's heel and the top of the shoe sole, resulting in an annoying and uncomfortable feel to the wearer's foot as the wearer continues walking.

SUMMARY OF THE INVENTION

The present invention overcomes the problems associated with the prior art combination shoe and sock by providing a novel construction of a combination sock and shoe that securely holds the shoe sole to the heel of a wearer's foot as the wearer walks wearing the combination sock and shoe. The combination sock and shoe of the invention is basically comprised of a shoe sole, an exterior sock that is secured to the shoe sole, an intermediate sock that is positioned inside the exterior sock and is provided with an elastic ankle opening, and an interior sock that is positioned inside the exterior sock and the intermediate sock and is constructed of the same material as the exterior sock.

The shoe sole of the combination sock and shoe is constructed of materials typically employed in constructing the soles of casual shoes such as slippers and athletic shoes. The shoe sole basically has a top surface, a bottom surface, and a sidewall that surrounds the shoe sole. The shoe sole bottom surface is the traction surface of the combination sock and shoe.

The exterior sock can be constructed of any fabric or material typically employed in constructing socks. The exterior sock is also constructed with the typical configuration of a sock. A bottom portion of the exterior sock is secured to the top surface of the shoe sole. A top portion or vamp portion of the exterior sock extends upwardly from and over the bottom portion of the exterior sock, defining a forward foot area of the sock and shoe combination. A heel portion of the exterior sock extends upwardly from the bottom portion and rearwardly from the top portion and defines a rearward foot area of the combination sock and shoe. An ankle portion of the exterior sock extends upwardly from both the vamp portion and heel portion and defines an ankle opening into the exterior sock.

The intermediate sock is positioned inside the exterior sock. The intermediate sock has the general configuration and construction of an anklet sock and is constructed of materials typically used in the construction of such socks. The intermediate sock includes a bottom portion that overlays the bottom portion of the exterior sock, a top portion that extends over the bottom portion of the intermediate sock and is positioned just below the top portion or vamp portion of the exterior sock, and a heel portion that is positioned just inside of the heel portion of the exterior sock and is connected to the top portion of the intermediate sock. A band having elastic property surrounds an ankle opening of the intermediate sock. The band can be stretched from a contracted shape to an expanded shape, where the ankle opening of the intermediate sock in the expanded shape is larger than the ankle opening in the contracted shape. The elastic properties of the band enable the intermediate sock ankle opening to return to the contracted ankle opening area after being stretched to the expanded ankle opening area.

The interior sock is positioned inside the exterior sock and inside the intermediate sock. The interior sock is constructed of the same material as the exterior sock and with the same configuration as the exterior sock. The insertion of the interior sock into the exterior sock and into the intermediate sock results in the intermediate sock being sandwiched between the interior sock and the exterior sock. Thus, the intermediate sock is concealed from view. In addition, the interior sock extending into the intermediate sock enables the wearer's foot to be easily inserted through the elastic band ankle opening of the intermediate sock and into the combination sock and shoe by inserting the wearer's foot into the combination sock and shoe in the same manner as inserting the foot into a conventional sock.

With the wearer's foot inserted into the combination sock and shoe, the elastic band of the intermediate sock securely engages around the ankle of the wearer's foot. This secures the combination sock and shoe to the wearer's foot. When walking with the combination sock and shoe on the wearer's foot, as the heel of the foot is lifted during a stride, the elastic band of the intermediate sock securely holds the shoe's sole adjacent the bottom of the wearer's heel and thereby prevents the disadvantage of prior art combination shoes and socks where the heel will lift away from the shoe sole during a stride and the material of the sock that was surrounding the ankle then slides beneath the heel.

BRIEF DESCRIPTION OF THE DRAWINGS

Further features of combination sock and shoe are set forth in the following detailed description of the invention and in the drawing figures.

DETAILED DESCRIPTION OF THE PREFERRED EMBODIMENT

Figure 1:
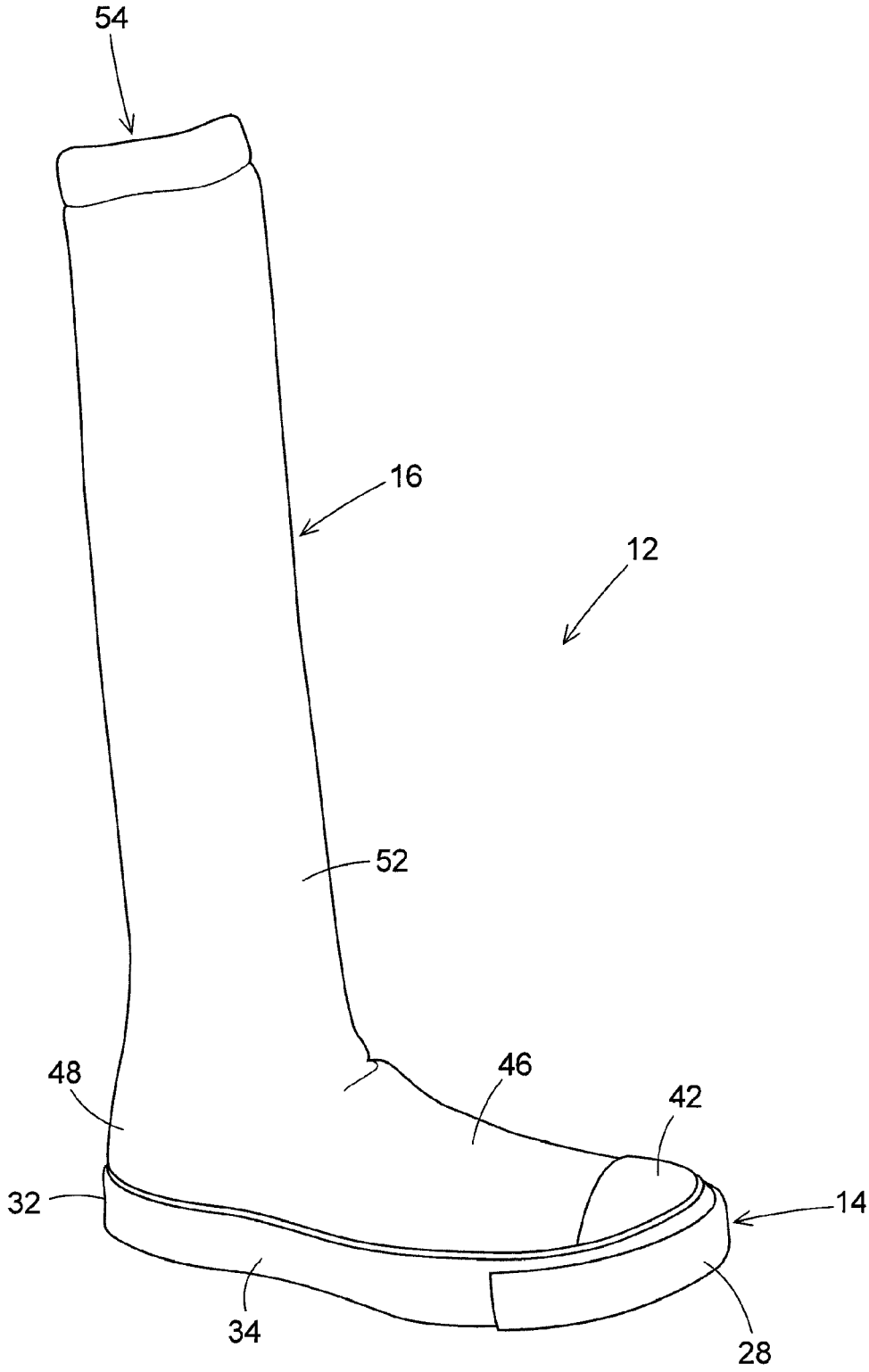
FIG. 1 is a side perspective view of the combination sock and shoe of the invention.
Figure 2:
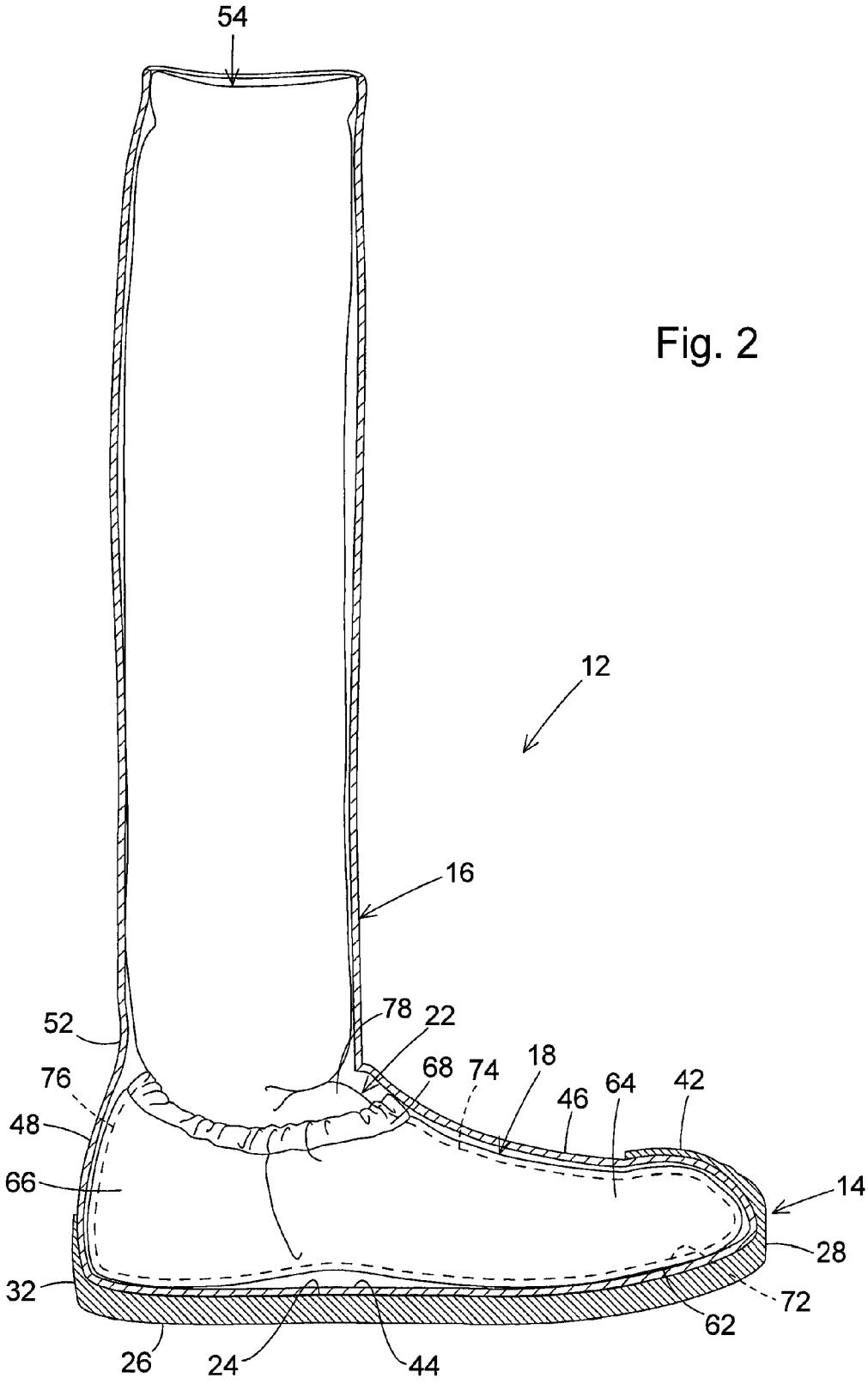
FIG. 2 is a side cross-section view of the combination sock and shoe of the invention.
Figure 3:
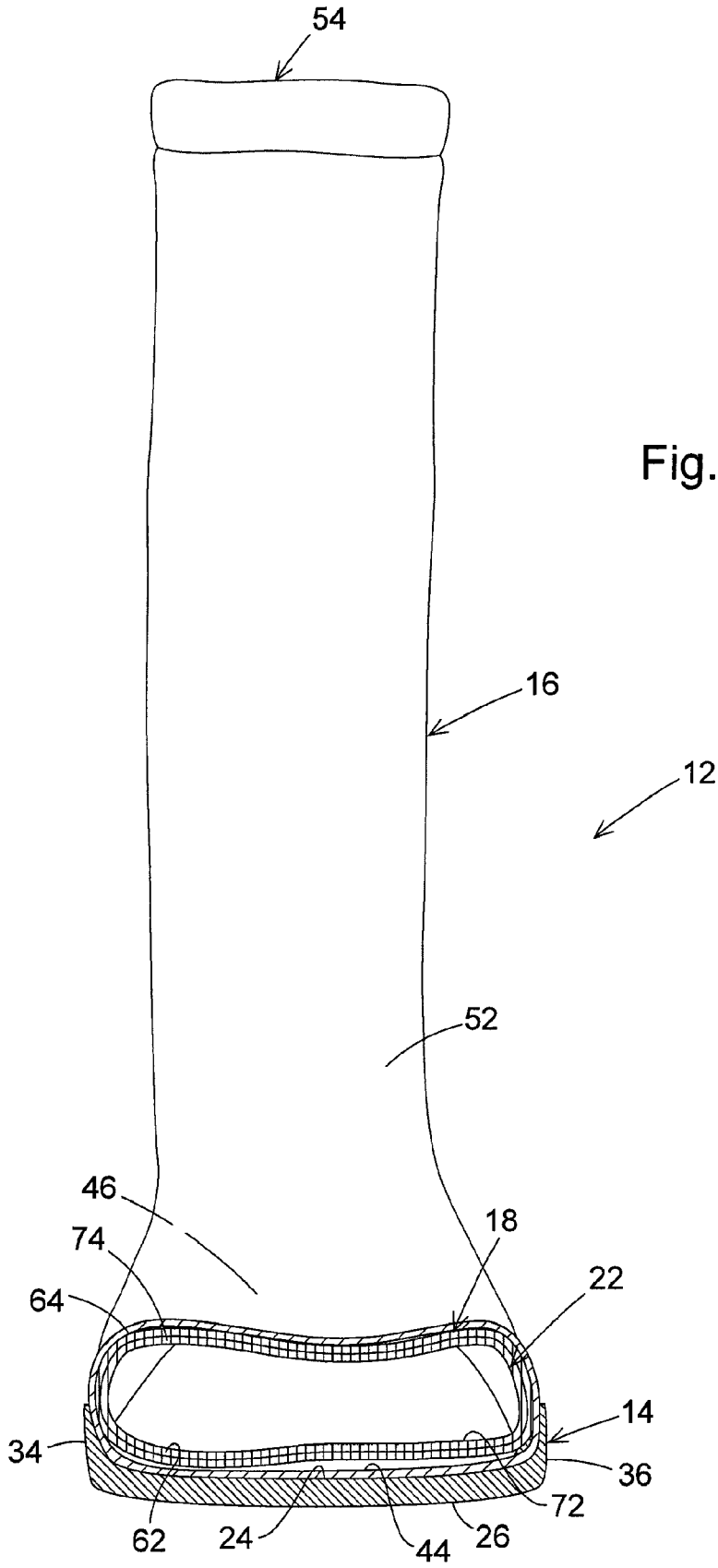
FIG. 3 is a front cross-section view of the combination sock and shoe.
Figure 4:
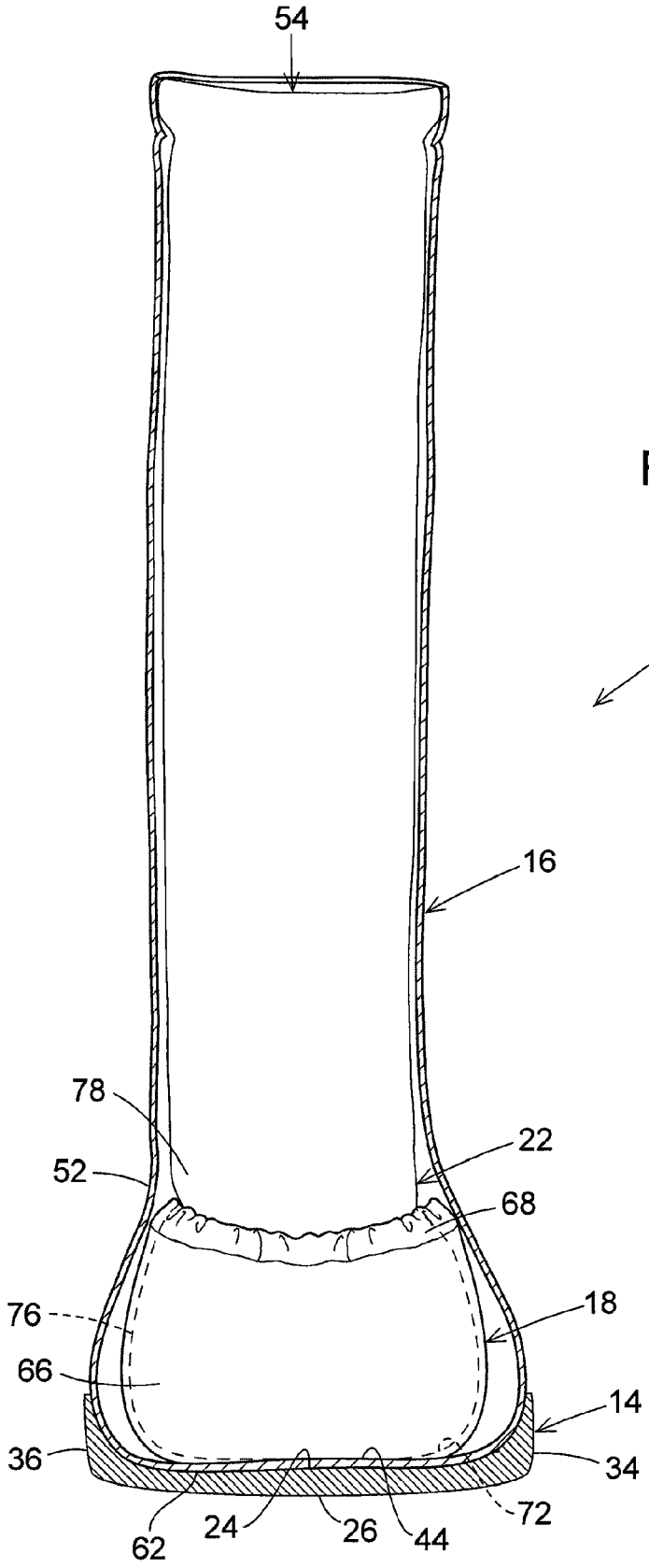
FIG. 4 is a rear cross-section view of the sock and shoe.

As stated earlier, the novel construction of the combination sock and shoe of the invention 12 shown in the drawing FIGS. 1-4 overcomes disadvantages associated with prior art shoe and sock constructions by securely holding the sole of the combination sock and shoe to the heel of a wearer's foot as the wearer walks wearing the combination sock and shoe. The construction of the combination sock and shoe 12 is basically comprised of a shoe sole 14, an exterior sock 16, an intermediate sock 18, and an interior sock 22.

The combination sock and shoe of the invention is described herein and is shown in the drawing figures by only referring to one of a left foot and right foot pair of the combination sock and shoe. Because the left and right foot pairs are mirror images of each other, only one combination sock and shoe of the invention is described herein.

The shoe sole 14 is constructed of materials typically employed in constructing the soles of casual shoes such as slippers and athletic shoes. In addition, the shoe sole 14 of the invention could have substantially the same constructions as other known casual shoes that provide comfortable support to the bottom of the wearer's foot. In view of this, the sole 14 of the combination sock and shoe 12 is shown only generally in the drawing figures, without specific details of the sole construction being shown or described herein. The sole 14 basically has a top surface 24 that supports the wearer's foot, and an opposite bottom surface 26 that functions as the traction surface of the combination sock and shoe 12. The sole 14 also has a sidewall that extends completely around the sole and separates the top surface 24 from the bottom surface 26. The sidewall has opposite toe 28 and heel 32 sections, and opposite side sections 32, 34 that together completely surround the shoe sole 14. In the cross-section view of FIGS. 2-3, it can be seen that an upper margin of the sole sidewall extends upwardly from the sole top surface 24.

In the illustrated embodiment of the combination sock and shoe 12 shown in the drawing figures, a toe cap 42 is provided over the toe area of the shoe sole 14. In other embodiments of the combination sock and shoe 12, the toe cap 42 could be eliminated.

The exterior sock 16 is secured to the top surface 24 of the shoe sole 14. Adhesives or other equivalent methods could be employed in securing the exterior sock 16 to the shoe sole 14. The exterior sock 16 is constructed of fabric or material typically employed in constructing socks. Such materials could have elastic properties that will securely hold the exterior sock 16 around the configuration of a wearer's foot and ankle. Furthermore, the exterior sock 16 shown in the drawing figures has an extended length that will extend well over the calf of a wearer's leg. This extended length of the exterior sock 16 is illustrative only, and the exterior sock of the combination sock and shoe of the invention could have a much shorter length.

Referring to FIGS. 24, the exterior sock 16 has a bottom portion 44 that is secured to the top surface 24 of the shoe sole 14. This bottom portion 44 is basically dimensioned to underlie the bottom of a wearer's foot. The exterior sock 16 extends upwardly from the shoe sole 14 adjacent the sidewall of the shoe sole. A vamp portion 46 of the exterior sock extends upwardly from the bottom portion 44 from the toe section 28 of the sole sidewall and adjacent the side sections 34, 36 of the sole sidewall. The vamp portion 46 is dimensioned to cover over a forward portion of a wearer's foot.

A heel portion 48 of the exterior sock 16 also extends upwardly from the bottom portion 44. The heel portion 48 of the exterior sock extends upwardly along the heel section 32 of the shoe sole sidewall and along the side sections 34, 36 of the sidewall. The heel portion extends forwardly and joins with the vamp portion 46 of the exterior sock and is dimensioned to surround the heel of a wearer's foot.

An ankle portion 52 of the exterior sock 16 extends upwardly from the sock vamp portion 46 and heel portion 48. The embodiment of the combination sock and shoe 12 in the drawing figures comprises an exterior sock ankle portion 52 that extends upwardly a significant distance from the exterior sock vamp portion 46 and heel portion 48. In other embodiments of the invention, the length of the ankle portion 52 could be much shorter with the ankle portion 52 extending only around the ankle of a wearer's foot. The top of the exterior sock ankle portion 52 defines an ankle opening 54 into the combination sock and shoe 12.

In the embodiment of the combination sock and shoe 12 shown in the drawing figures, the upper portions of the shoe sole sidewall sections 28, 32, 34, 36 extend over the exterior sock 16. These upward extensions of the sidewall of the shoe sole 14 provide a secure connection between the shoe sole 14 and the exterior sock 16. In other embodiments of the combination sock and shoe, it is not necessary that the sidewall of the shoe sole 14 extend above the sole top surface 24. In such embodiments, only the bottom portion 44 of the exterior sock 16 is secured to the shoe sole top surface 24.

The intermediate sock 18 is secured inside the exterior sock 16. The intermediate sock 18 in the preferred embodiment shown has the general configuration and construction of an anklet sock. The material employed in constructing the intermediate sock 18 could be the same fabric or material employed in constructing the exterior sock 16, or could be a different fabric or material. The intermediate sock 18 has the same basic construction as the exterior sock 16, but the dimensions of the intermediate sock 18 are slightly smaller than those of the exterior sock 16. This allows the intermediate sock 18 to be positioned inside the exterior sock 16 and to engage in surface contact with the exterior sock 16 without being visibly present from outside of the exterior sock 16. The intermediate sock 18 has a bottom portion 62 that overlays and is secured to the exterior sock bottom portion 44. A vamp portion 64 of the intermediate sock 18 extends upwardly from the bottom portion 62 of the sock and is positioned just inside of and against the exterior sock vamp portion 46. The intermediate sock 18 also has a heel portion 66 that extends upwardly from the bottom portion 62 and is positioned just inside of and against the exterior sock heel portion 48. An ankle portion 68 of the intermediate sock 18 connects and extends upwardly from the vamp portion 64 and heel portion 66. The ankle portion 68 of the intermediate sock 18 is not secured to the exterior sock 16 and is free to move relative to the exterior sock 16. The ankle portion 68 of the interior sock has elastic properties that enable an ankle opening into the intermediate sock 18 to be stretched from a contracted ankle opening area to an expanded ankle opening area that is larger than the contracted ankle opening area. The elastic properties also enable the intermediate sock ankle opening to return to the contracted ankle opening area after being stretched to the expanded ankle opening area. These elastic properties of the ankle portion 68 of the intermediate sock 18 can be provided by constructing this portion of the sock from elastic materials. They could also be provided by an elastic band that extends around the ankle opening of the intermediate sock 18. Other equivalent means of contracting the ankle opening of the intermediate sock 18 could also be employed.

The interior sock 22 is positioned inside the exterior sock 16 and inside the intermediate sock 18. In the preferred embodiment of the invention, the interior sock 22 is constructed of the same materials as the exterior sock 16, thereby giving the visual impression that the interior sock 22 is actually the interior of the exterior sock 16. The intermediate sock 18 is concealed from view between the interior sock 22 and the exterior sock 16. The interior sock 22 is also constructed with slightly smaller dimensions than the exterior sock 16 and the intermediate sock 18 to enable its positioning in the exterior sock and interior sock. Thus, the interior sock 22 has a bottom portion 72 that overlays both the intermediate sock bottom portion 62 and the exterior sock bottom portion 44. The sock also has a vamp portion 74 that extends upwardly from the bottom portion 72 just inside of the intermediate sock vamp portion 64 and the exterior sock vamp portion 46. The intermediate sock 22 also has a heel portion 76 that extends upwardly from the bottom portion 72 just inside of the intermediate sock heel portion 66 and the exterior sock heel portion 48. An ankle portion 78 of the interior sock 22 extends upwardly from the vamp portion 74 and the heel portion 76 of the sock, through the ankle opening defined by the ankle portion 68 of the intermediate sock 18, and upwardly through the interior of the exterior sock ankle portion 52. Thus, the interior sock 22 and exterior sock 16 sandwich the intermediate sock 18 between them, and thereby conceal the intermediate sock from view. In addition, the interior sock 22 extending into the intermediate sock 18 and the exterior sock 16 enables the wearer's foot to be easily inserted through the elastic ankle opening 68 of the intermediate sock 18 and into the combination sock and shoe 12 by inserting the wearer's foot into the interior sock 22 in the same manner as inserting the foot into a conventional sock.

With the wearer's foot inserted into the combination sock and shoe 12, the elastic properties of the intermediate sock ankle portion 68 securely engage the ankle portion 68 around the ankle of the wearer's foot. This secures the combination sock and shoe 12 to the wearer's foot. When walking with the combination sock and shoe on the wearer's foot, as the heel of the foot is lifted from the sole 14 during a stride, the elastic properties of the intermediate sock ankle portion 68 securely hold the shoe sole 14 adjacent the bottom of the wearer's heel and thereby prevents the disadvantage of prior art combination shoes and socks where the heel will lift away from the shoe sole during a stride and the material of the sock that was surrounding the ankle then slides beneath the heel.

Although the combination sock and shoe of the invention has been described above by referring to a particular embodiment, it should be understood that modifications and variations could be made to the combination sock and shoe without departing from the intended scope of the following claims.

What is claimed is:

1. A combination sock and shoe comprising:

a shoe sole having opposite top and bottom surfaces and a sidewall that extends entirely around the shoe sole and separates the top surface and the bottom surface, the sidewall having a toe section and a heel section at opposite ends of the shoe sole and the sidewall having a left side section and a right side section at opposite sides of the shoe sole, the shoe sole bottom surface being an exterior traction surface of the shoe sole;

an exterior sock constructed of a flexible material that is more flexible than the shoe sole, the exterior sock being secured to the shoe sole top surface and extending upwardly from the shoe sole sidewall, the exterior sock having a bottom portion that is secured to the shoe sole top surface, a vamp portion that extends upwardly from the bottom portion along the left side section, the right side section, and the toe section of the shoe sole sidewall, a heel portion that extends upwardly from the bottom portion along the left side section, the right side section, and the heel section of the shoe sole sidewall, and an ankle portion that extends upwardly from the vamp portion and the heel portion and extends around an ankle opening of the exterior sock, where the bottom portion, the vamp portion, and heel portion and the ankle portion of the exterior sock are a single continuous piece of material;

an intermediate sock inside the exterior sock and secured to the exterior sock, the intermediate sock having a bottom portion that overlays the exterior sock bottom portion, the intermediate sock having a vamp portion that extends upwardly from and over the intermediate sock bottom portion and is positioned inside of and against the exterior sock vamp portion, and intermediate sock having a heel portion that extends upwardly from the intermediate sock bottom portion and is positioned inside of and against the exterior sock heel portion, the intermediate sock having an ankle portion that extends upwardly from the intermediate sock vamp portion and the intermediate sock heel portion and around an ankle opening of the intermediate sock, and the intermediate sock ankle portion having elastic properties that enable the intermediate sock ankle opening to be stretched from a contracted ankle opening area to an expanded ankle opening area that is larger than the contracted ankle opening area, and that enable the intermediate sock ankle opening to return to the contracted ankle opening area after being stretched to the expanded ankle opening area; and, an interior sock inside of the exterior sock and the intermediate sock, the interior sock having a bottom portion that overlays the intermediate sock bottom portion, the interior sock having a vamp portion that extends upwardly from the interior sock bottom portion and is positioned inside and against the intermediate sock vamp portion, the interior sock having a heel portion that extends upwardly from the interior sock bottom portion and is positioned inside of and against the intermediate sock heel portion, and the interior sock having an ankle portion that extends upwardly from the interior sock vamp portion and the interior sock heel portion and through the intermediate sock ankle opening, allowing the interior sock ankle portion to be positioned inside of and against the exterior sock ankle portion.

2. The combination sock and shoe of claim 1, further comprising:

the exterior sock and the interior sock both extending upwardly from the shoe sole beyond the intermediate sock ankle portion.

3. The combination sock and shoe of claim 1, further comprising:

the exterior sock ankle portion being separate from and not secured to the intermediate sock ankle portion.

4. The combination sock and shoe of claim 1, further comprising:

the exterior sock and the interior sock being constructed of a same material.

5. The combination sock and shoe of claim 1, further comprising:

the exterior sock being constructed of a continuous material that completely surrounds a wearer's foot;

the intermediate sock being constructed of a continuous material that completely surrounds a wearer's foot; and, the interior sock being constructed of a continuous material that completely surrounds a wearer's foot.

* * * * *